United States Patent [19]

Moss et al.

[11] Patent Number: 4,466,152

[45] Date of Patent: Aug. 21, 1984

[54] BOWL MOP

[75] Inventors: Theron C. Moss, Cleveland; Earl Boring, McDonald, both of Tenn.; Irwin Tomm, Cleveland, Ohio

[73] Assignee: Seco Industries, Inc., Cleveland, Tenn.

[21] Appl. No.: 374,336

[22] Filed: May 3, 1982

[51] Int. Cl.[3] ..... A47L 13/24; B25G 1/04; B25G 3/12

[52] U.S. Cl. ..... 15/229 A; 15/144 B; 15/145; 15/147 R; 15/176; 403/104

[58] Field of Search ..... 15/144 B, 145, 147 R, 15/176, 228, 229 R, 229 A, 210 R; 403/104, 350, 351, DIG. 8, DIG. 7; 16/115

[56] References Cited

U.S. PATENT DOCUMENTS

| | | | |
|---|---|---|---|
| 1,797,366 | 3/1931 | Rackliffe | 15/145 X |
| 2,242,869 | 5/1941 | Phipps | 15/147 R |
| 2,526,415 | 10/1950 | Refsdal | 403/DIG. 7 |
| 2,825,084 | 3/1958 | Sanborn | 15/229 A X |
| 4,127,911 | 12/1978 | Cupp et al. | 15/210 R |
| 4,150,457 | 4/1979 | Larson | 15/167 R |
| 4,155,140 | 5/1979 | Janssen et al. | 15/145 X |
| 4,245,368 | 1/1981 | Cotey et al. | 15/229 R |
| 4,300,258 | 11/1981 | Burns et al. | 15/176 X |

FOREIGN PATENT DOCUMENTS

| | | | |
|---|---|---|---|
| 224353 | 11/1924 | United Kingdom | 15/229 R |
| 686252 | 1/1953 | United Kingdom | 15/144 B |
| 1527393 | 10/1978 | United Kingdom | 403/350 |
| 2044089 | 10/1980 | United Kingdom | 15/176 |

*Primary Examiner*—Edward L. Roberts
*Attorney, Agent, or Firm*—Maky, Renner, Otto & Boisselle

[57] ABSTRACT

A bowl mop for use in cleaning toilet bowls and the like including a disposable yarn head having a slide portion slidably received in a slot on a projecting end portion of a handle. The slide is releasably retained within the slot as by engagement of a cam projection on the slide in a recess in the handle end portion to permit the disposable yarn head to be snapped off for easy disposal and replaced with a replacement head. The handle end portion extends at an angle relative to the longitudinal axis of the handle to facilitate cleaning of difficult to reach areas. Also, the handle is adjustable to different lengths for safer, faster cleaning with less bending and stooping and less operator fatigue.

20 Claims, 6 Drawing Figures

10°

BOWL MOP

BACKGROUND OF THE INVENTION

This invention relates generally, as indicated, to a bowl mop, especially suited for use in cleaning toilet bowls and the like.

Heretofore, one of the most common ways to clean a toilet bowl was to scrub the interior surface of the bowl with a brush or similar type cleaning device. However, there has been a long standing problem of what to do with the cleaning device following the cleaning operation.

In many cases the cleaning device can be cleaned and stored for reuse. However, most people do not want to go to the bother of doing that. Nor do they want to throw the device away. Accordingly, the device is likely to be kept for reuse without adequate cleaning, which may provide a breeding place for germs and the like as well as a source for unpleasant odors.

Another drawback of such prior cleaning devices is that they require the user to do a great deal of bending or stooping in order to clean effectively, which is not only fatiguing, but may place the user closer than desired to unpleasant odors or potentially harmful acid fumes and the like. Moreover, in general such prior art cleaning devices are not readily suited for cleaning difficult to reach areas.

SUMMARY OF THE INVENTION

With the foregoing in mind, it is a principal object of this invention to provide a cleaning device for use in cleaning toilet bowls and the like including a disposable cleaning portion which can readily be removed and replaced after use.

Another object is to provide such a cleaning device which facilitates cleaning difficult to reach areas.

Still another object is to provide such a cleaning device which provides for safer, faster cleaning with less bending and stooping and less operator fatigue.

A further object is to provide such a cleaning device which permits the user to keep well away from unpleasant odors or potentially harmful acid fumes and the like during use.

These and other objects of the present invention may be achieved by providing the cleaning device with a disposable cleaning head on a projecting end portion of a handle. The disposable cleaning head includes a slide which is slidably received in a slot on such projecting end portion and is releasably retained in place as by engagement of a cam projection on the slide in a recess or opening in the projecting end portion. To remove the cleaning head, all the operator has to do is apply an axial force to the slide to cause the projection to cam out of the recess and the slide to move axially out of the slot. The disposable head can be removed by hand or by using the handle to pull the cleaning head across the leading edge of a waste receptacle to snap the cleaning head off. The cleaning head may then be discarded and replaced with a replacement head by inserting the slide of the replacement head into the slot and pushing on the slide until the projection snaps into the recess in the projecting end portion thus locking the replacement head in place.

The projecting end portion desirably extends at an angle relative to the longitudinal axis of the handle to facilitate cleaning of difficult to reach areas, such as under fixture edges and the like. Also, the handle is desirably adjustable to different lengths to provide for safer, faster cleaning with less bending and stooping and less operator fatigue. The extension handle also allows the user to keep well away from unpleasant odors and potentially harmful acid fumes and the like during cleaning.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings

DETAILED DESCRIPTION OF THE PREFERRED EMBODIMENT

Figures 1, 2, 3, 4, 5, 6:
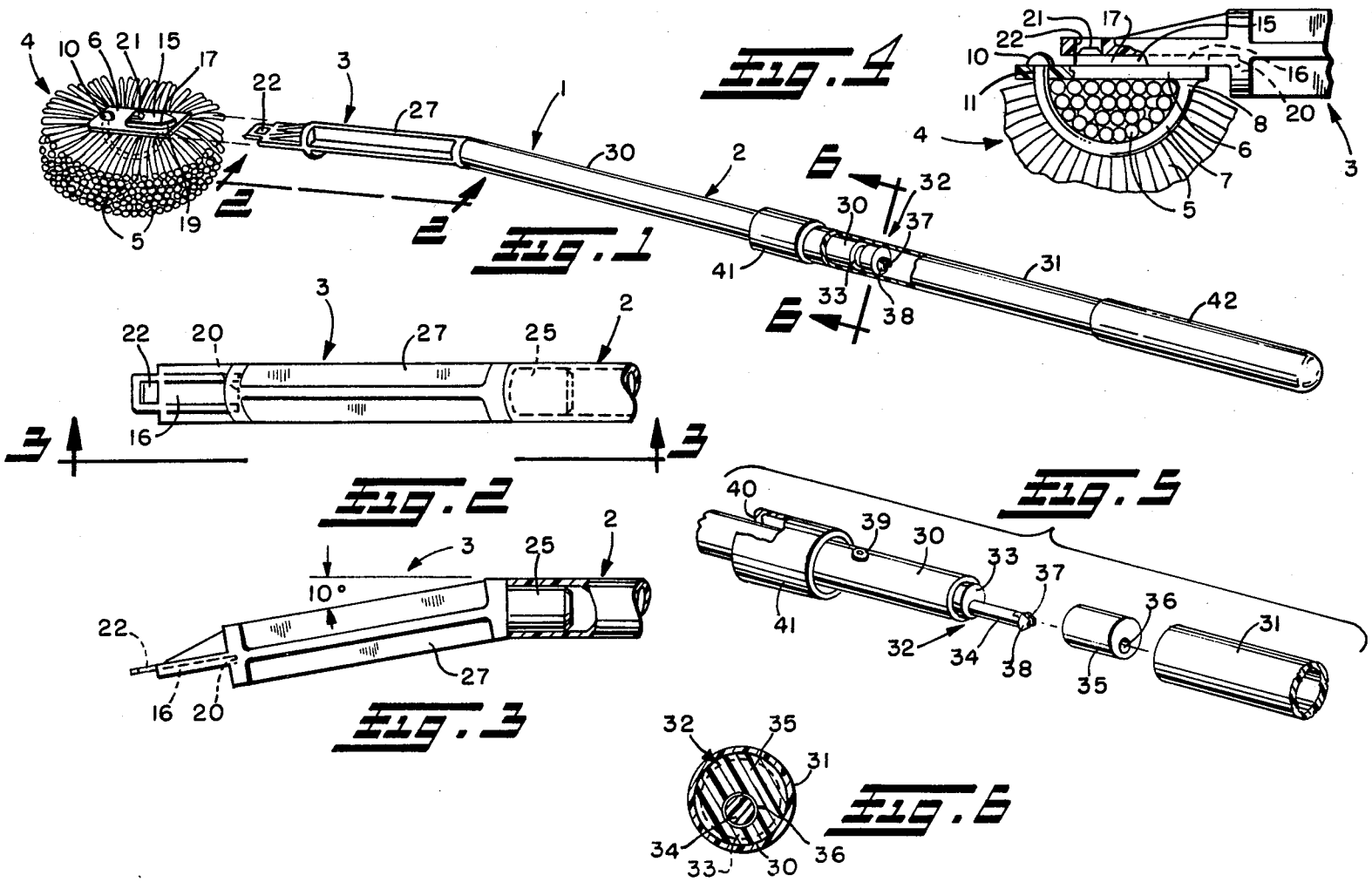
FIG. 1 is a perspective view of a preferred form of bowl mop in accordance with this invention showing the cleaning head portion disengaged from the handle end portion and the extension handle partially broken away to show the lock for the telescoping members.
FIG. 2 is an enlarged fragmentary bottom plan view of the handle end portion of FIG. 1 as seen from the plane of the line 2—2 thereof.
FIG. 3 is a fragmentary side elevation view of the handle end portion of FIG. 2 as seen from the plane of the line 3—3 thereof.
FIG. 4 is an enlarged fragmentary side elevation view of the handle end portion and cleaning head portion attached thereto, partly in section to show how the yarns are secured to the head portion and how the head portion is attached to the handle end portion.
FIG. 5 is a fragmentary exploded perspective view of the extension handle of such mop and lock mechanism for locking the extension handle in the desired adjusted position.
FIG. 6 is an enlarged transverse section through the lock mechanism and extension handle, taken on the plane of the line 6—6 of FIG. 1.

Referring now in detail to the drawings and initially to FIG. 1 thereof, there is shown a preferred form of bowl mop 1 in accordance with this invention including a handle member 2 having a projecting end portion 3 on one end to which a disposable cleaning head 4 may be removably attached as described hereafter. The cleaning head 4 desirably includes a plurality of short strands 5 of yarn or yarn-like material bunched together intermediate their ends and secured to a plastic base member 6 as by a plastic loop 7 extending around the yarns and having its ends suitably anchored to the base member. As best seen in FIG. 4, one end 8 of the plastic loop may be integrally molded with the base member, whereas the other end has a rounded button 10 thereon adapted to be snap-fitted into an opening 11 in the base member to lock the yarns in place. When thus assembled, the yarns form a puff of material which may be effectively used to clean the interior of toilet bowls or other surfaces.

In the preferred form of the invention shown herein, such yarn cleaning head 4 may be removably attached to the projecting handle end portion 3 by providing a slide 15 on the side of the base member opposite the yarns adapted to be received in a dove-tail slot 16 in the outermost end of the handle end portion. The slide is also preferably made of a suitable plastic material and may be integrally molded with the base member. The sides 17 of the slide 15 are tapered inwardly for engagement with the correspondingly tapered sides of the slot 16. Moreover, the inner end 19 of the slide is preferably rounded as shown in FIG. 1 to facilitate insertion into the slot.

A shoulder 20 at the inner end of the slot limits the extent of axial inward movement of the slide along the slot. Also, a cam projection 21 adjacent the outer end of the slide is adapted to be received in a recess or opening 22 in the projecting end portion 3 adjacent the outer end of the slot when the slide is fully inserted into the slot to releasably lock the cleaning head in place.

To replace the cleaning head, all the operator need do is apply sufficient axial pulling force to the cleaning head to cause the cam projection 21 on the slide to cam out of the slot 22, after which the slide can readily be removed from the slot. The disposable cleaning head can be removed by hand or snapped off by quickly pulling on the handle after hooking the cleaning head across the leading edge of a waste receptacle or the like, whereby the disposable cleaning head will drop into the receptacle without having to touch it. A replacement head may then be attached to the handle by inserting the slide of the replacement head into the slot and pushing on it until the cam projection snaps into the recess in the handle end portion thus locking the replacement head in place.

The handle end portion 3 is preferably molded from a suitable plastic material separately from the handle 2 and desirably extends at an angle relative to the longitudinal axis of the handle to facilitate cleaning of difficult to reach areas, such as under fixture edges and the like. In the preferred form shown, such handle end portion extends at an angle of approximately 10° relative to the longitudinal axis of the handle and has a length of approximately 4 inches. On the inner end of the handle end portion is an angularly disposed stub shaft 25 which is adapted to be received in the outer end of the handle 2 and secured thereto as by using a suitable adhesive. Between the stub shaft 25 and the slot 16, the handle end portion 3 desirably consists of a plurality of radially extending ribs 27 to reduce the amount of material required to mold the handle end portion while providing the necessary strength and rigidity. In the preferred form shown, four such radial ribs 27 are provided.

The handle itself desirably consists of a pair of telescoping tubular handle parts 30, 31 which may be adjusted to different lengths to reduce the amount of bending or stooping required during cleaning. Both such telescoping handle parts are preferably made from relatively thin-walled plastic extruded tubing, with the outer diameter of the inner tubular member 30 being slightly less than the inner diameter of the outer tubular member 31 to permit the tubular members to be telescopically received one within the other and axially displaced relative to each other. A suitable lock mechanism 32 is also provided for releasably locking the telescoping handle parts 30, 31 in any desired adjusted position.

In the preferred embodiment shown herein, such tubular lock mechanism 32 consists of a cylindrically shaped plug 33 having a diameter substantially equal to the inner diameter of the inner telescoping member 30 for insertion in the inner end thereof and secured in place as by a suitable adhesive. Extending from the plug 33 is a hub 34 whose axis is eccentric relative to the axis of the plug. Rotatably mounted on the hub is an eccentric collar or ring 35 having an outer diameter substantially equal to the inner diameter of the outer telescoping member 31. The ring 35 has an eccentric bore 36 therein through which the hub 34 extends.

The eccentricity of the ring 35 is the same as that of the hub 34. Accordingly, when the telescoping handle parts 30, 31 are rotated relative to each other to cause the exterior surface of the ring 35 to be concentric with the plug 33, the telescoping handle parts may be moved axially relative to each other. Conversely, when the telescoping handle parts are rotated to cause the ring 35 to be eccentric relative to the plug 33, the telescoping handle parts will be locked against relative axial movement.

To facilitate assembly of the ring 35 on the hub 34 and retain the ring in place, the outer end of the hub may be slotted at 37 and have a tapered flange 38 thereon which permits the ring to be slid over the flange and onto the hub but prevents removal therefrom.

The maximum separation between the two handle parts 30, 31 may be determined by providing a stop such as a rivet 39 adjacent the inner end of the inner tubular member 30 engageable with an inturned flange 40 on the outer end of a vinyl sleeve 41 attached to the inner end of the outer tubular member 31 as by a suitable adhesive. A plastic hand grip 42 or the like may also be provided at the outer end of the outer tubular member 31 which acts as a closure for such outer end and precludes axial inward movement of the inner tubular member beyond the outer end of the outer tubular member.

In one form of such bowl mop, the handle preferably telescopes from approximately 17 to 25 inches, and locks in any position in between, to minimize the amount of bending and stooping required during cleaning, thus reducing operator fatigue, and also permitting the operator to keep well away from unpleasant odors and potentially harmful acid fumes and the like.

From the foregoing, it will now be apparent that the bowl mop of the present invention provides for easy removal and replacement of the cleaning head by snapping off the old head and snapping on a new replacement head. Also, the telescoping handle with angled handle end portion provides for safer, faster cleaning with less bending and stooping, and keeps the user well away from unpleasant odors and the like.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A cleaning device for use in cleaning toilet bowls and the like comprising a handle having a projecting end portion, and a disposable cleaning head attached to said projecting end portion, said projecting end portion having a longitudinal slot in the outer end thereof, and said disposable cleaning head having a slide which is slidably received in said slot, one of said disposable cleaning head and said projecting end portion having a cam projection thereon, and the other of said disposable cleaning head and projecting end portion having a recess therein which is engaged by said cam projection to releasably secure said disposable cleaning head to said projecting end portion, said projecting end portion extending at an angle relative to the longitudinal axis of said handle to facilitate cleaning of difficult to reach areas such as under fixture edges and the like, said projecting end portion being made separately from said handle, said projecting end portion having a stub shaft on the end opposite said slot, said stub shaft being angularly disposed relative to the longitudinal axis of said projecting end portion and extending into the outer end of said handle for attachment thereto.

2. The cleaning device of claim 1 wherein said projecting end portion includes a plurality of radially extending ribs between said stub shaft and said slot.

3. The cleaning device of claim 1 wherein said projecting end portion extends at an angle of approximately 10° relative to the longitudinal axis of said handle.

4. The cleaning device of claim 1 wherein said cam projection is on said slide adjacent the outer end thereof, and said recess comprises an opening extending through the outer end of said projecting end portion adjacent the outer end of said slot.

5. The cleaning device of claim 1 wherein said handle includes inner and outer telescoping tubular members axially adjustable to different lengths, and lock means for releasably locking said tubular members in any desired adjusted position.

6. The cleaning device of claim 5 wherein said lock means comprises a cylindrical plug received in the axial inner end of said inner tubular member, said plug having an eccentric hub extending axially outwardly therefrom, and an eccentric ring rotatably mounted on said hub, said ring having an outer diameter substantially equal to the inner diameter of said outer tubular member and received therewithin, whereby when said tubular members are rotated relative to each other to cause the exterior surface of said ring to be concentric with said plug, said tubular members may be moved axially relative to each other, and when said tubular members are rotated to cause said ring to be eccentric relative to said plug, said tubular members are locked against relative axial movement.

7. The cleaning device of claim 6 wherein said ring has an eccentric bore through which said hub extends, and the outer end of said hub is slotted and has a tapered flange thereon which permits said ring to be slid over said flange and onto said hub but prevents removal therefrom.

8. A cleaning device for use in cleaning toilet bowls and the like comprising a handle having a projecting end portion, and a disposable cleaning head attached to said projecting end portion, said projecting end portion having a longitudinal slot in the outer end thereof, and said disposable cleaning head having a slide which is slidably received in said slot, one of said disposable cleaning head and said projecting end portion having a cam projection thereon, and the other of said disposable cleaning head and projecting end portion having a recess therein which is engaged by said cam projection to releasably secure said disposable cleaning head to said projecting end portion, said disposable cleaning head including a base member, and a plastic loop for securing a plurality of short strands of yarn-like material bunched together intermediate their ends to said base member.

9. The cleaning device of claim 8 wherein said plastic loop has one end integrally molded with said base member, and the other end has a rounded button thereon which is snap-fitted into an opening in said base member to secure said strands to said base member.

10. The cleaning device of claim 8 wherein said plastic loop is connected to one side of said base member, said slide is on the opposite side of said base member from said loop, said cam projection is on said slide adjacent the outer end thereof, and said recess comprises an opening through the outer end of said projecting end portion adjacent the outer end of said slot.

11. A cleaning device for use in cleaning toilet bowls and the like comprising a handle having a projecting end portion, and a disposable cleaning head attached to said projecting end portion, said projecting end portion having a longitudinally extending dove-tail slot with parallel sides in the outer end thereof, and said disposable cleaning head having a slide which is slidably received in said slot, said slide having a shape corresponding to said dove-tail slot for sliding engagement therealong, the inner end of said slide being rounded to facilitate insertion of said slide into said slot, a shoulder at the inner end of said slot engageable by the inner end of said slide to limit the extent of axial inward movement of said slide along said slot, said slide having a cam projection extending perpendicular thereto adjacent the outer end thereof, and said projecting end portion having a recess adjacent the outer end of said slot which is engaged by said cam projection to releasably secure said disposable cleaning head to said projecting end portion, said projecting end portion extending at an angle relative to the longitudinal axis of said handle to facilitate cleaning of difficult to reach areas such as under fixture edges and the like, said projecting end portion being made separately from said handle and having a stub shaft on the end opposite said slot, said stub shaft being angularly disposed relative to the longitudinal axis of said projecting end portion and extending into the outer end of said handle for attachment thereto.

12. The cleaning device of claim 11 wherein said projecting end portion includes a plurality of radially extending ribs between said stub shaft and said slot.

13. The cleaning device of claim 11 wherein said handle includes inner and outer telescoping tubular members axially adjustable to different lengths, and lock means for releasably locking said tubular members in any desired adjusted position.

14. A cleaning device for use in cleaning toilet bowls and the like comprising a handle having a projecting end portion, and a disposable cleaning head attached to said projecting end portion, said projecting end portion having a longitudinally extending dove-tail slot with parallel sides in the outer end thereof, and said disposable cleaning head having a slide which is slidably received in said slot, said slide having a shape corresponding to said dove-tail slot for sliding engagement therealong, the inner end of said slide being rounded to facilitate insertion of said slide into said slot, a shoulder at the inner end of said slot engageable by the inner end of said slide to limit the extent of axial inward movement of said slide along said slot, said slide having a cam projection extending perpendicular thereto adjacent the outer end thereof, and said projecting end portion having a recess adjacent the outer end of said slot which is engaged by said cam projection to releasably secure said disposable cleaning head to said projecting end portion, said disposable cleaning head including a base member, and a plastic loop for securing a plurality of short strands of yarn-like material bunched together intermediate their ends to said base member.

15. The cleaning device of claim 14 wherein said plastic loop has one end integrally molded with said base member, and the other end has a rounded button thereon which is snap-fitted into an opening in said base member to secure said strands to said base member.

16. The cleaning device of claim 14 wherein said recess comprises an opening extending through the outer end of said projecting end portion.

17. The cleaning device of claim 14 wherein said projecting end portion extends at an angle relative to the longitudinal axis of said handle to facilitate cleaning of difficult to reach areas such as under fixture edges and the like, said projecting end portion being made separately from said handle.

18. A cleaning device for use in cleaning toilet bowls and the like comprising a handle having a projecting end portion, and a disposable cleaning head attached to said projecting end portion, said projecting end portion having a longitudinally extending dove-tail slot with parallel sides in the outer end thereof, and said disposable cleaning head having a slide which is slidably received in said slot, said slide having a shape corresponding to said dove-tail slot for sliding engagement therealong, the inner end of said slide being rounded to facilitate insertion of said slide into said slot, a shoulder at the inner end of said slot engageable by the inner end of said slide to limit the extent of axial inward movement of said slide along said slot, said slide having a cam projection extending perpendicular thereto adjacent the outer end thereof, and said projecting end portion having a recess adjacent the outer end of said slot which is engaged by said cam projection to releasably secure said disposable cleaning head to said projecting end portion, said handle including inner and outer telescoping tubular members axially adjustably to different lengths, and lock means for releasably locking said tubular members in any desired adjusted position.

19. The cleaning device of claim 18 wherein said lock means comprises a cylindrical plug received in the axial inner end of said inner tubular member, said plug having an eccentric hub extending axially outwardly therefrom, and an eccentric ring rotatably mounted on said hub, said ring having an outer diameter substantially equal to the inner diameter of said outer tubular member and received therewithin, whereby when said tubular members are rotated relative to each other to cause the exterior surface of said ring to be concentric with said plug, said tubular members may be moved axially relative to each other, and when said tubular members are rotated to cause said ring to be eccentric relative to said plug, said tubular members are locked against relative axial movement.

20. The cleaning device of claim 19 wherein said ring has an eccentric bore through which said hub extends, and the outer end of said hub is slotted and has a tapered flange thereon which permits said ring to be slid over said flange and onto said hub but prevents removal therefrom.

* * * * *